US005156072A

United States Patent [19]

Muralidharan

[11] Patent Number: 5,156,072

[45] Date of Patent: Oct. 20, 1992

[54] TORQUE WRENCH

[76] Inventor: Pillapalayam N. Muralidharan, 36 A, 4th Main Rd., T.N.H.B. Kolturpuram, Tamil Nadu, India, 600 085

[21] Appl. No.: 720,672

[22] Filed: Jun. 25, 1991

Related U.S. Application Data

[63] Continuation-in-part of Ser. No. 622,980, Dec. 6, 1990, abandoned.

[51] Int. Cl.[5] ..... B25B 23/155

[52] U.S. Cl. ..... 81/478; 81/481; 81/483

[58] Field of Search ..... 81/478, 480, 481, 483

[56] References Cited

U.S. PATENT DOCUMENTS

| | | | |
|---|---|---|---|
| 2,791,141 | 5/1957 | Johnson et al. | 81/481 |
| 2,996,940 | 8/1961 | Van Hoose | 81/481 |
| 3,140,623 | 7/1964 | Van Hoose | 81/483 |
| 4,541,313 | 9/1985 | Wise | 81/478 |

FOREIGN PATENT DOCUMENTS

| | | | |
|---|---|---|---|
| 232215 | 3/1960 | Australia | 81/481 |

*Primary Examiner*—D. S. Meislin

*Attorney, Agent, or Firm*—Bacon & Thomas

[57] ABSTRACT

A torque wrench capable of pre-setting specified torque values is disclosed which comprises an elongated housing and an output drive shaft. Pivotally secured to and located within the housing are a plurality of levers. A first lever is journalled to the output shaft for rotation therewith and the remaining levers are pivotally secured to the housing adjacent their first ends at spaced intervals along the longitudinal center line of the housing and, with the exception of the last of these levers, have second ends which engage the first end of the next, adjacent lever whereby pivoting of the first lever results in pivoting of each of the levers through their interconnections. Further included is a torque value setting assembly which acts between the housing and at least one of the levers to apply a force to the lever which must be overcome in order for that lever to pivot. The torque value setting assembly is readily adjustable to alter the pivoting resistance by varying the position along the length of the lever upon which the device acts. The torque wrench includes an indicating arrangement which provides an audible indication when the torque value set by the torque value setting assembly has been reached.

20 Claims, 3 Drawing Sheets

TORQUE WRENCH

This is a continuation-in-part application of Ser. No. 07/622,980 filed Dec. 6, 1990, now abandoned.

BACKGROUND OF THE INVENTION

The invention pertains to an adjustable torque wrench which is capable of being preset to specific torque values and which includes a means for indicating when the specified torque is reached.

Torque wrenches which can be set to desired torque values are known in the art. Such torque wrenches substantially reduce the time and effort for setting a specific torque when tightening bolts, nuts, spark plugs, etc. In one known type of prior art arrangement, an externally threaded shaft is received within an internally threaded tube for the purpose of setting the torque value. Over time, wear and tear will occur on the threads between the shaft and tube which results in a reduction in the accuracy of the torque setting system.

It is also known in the art of torque wrenches to have a torque release connection between a manually engageable handle and a torque applying member. In these types of wrenches, as represented by U.S. Pat. Nos. 2,996,940 and 3,355,970, the torque setting value of the wrench can be adjusted by varying the mechanical advantage of the level-type connection between the wrench handle and the torque applying member. When a preset torque value has been reached, the releasable connection between the member and the handle prevents further torque application through the torque-applying member. The release of this connection provides an abrupt indication that the desired, preset torque limit has been reached.

Therefore, based on the above discussed prior art, there exists a need for a torque wrench having an adjustable torque setting which does not need to be recalibrated or will lose its accuracy over a long period of time. There also exists a need for an adjustable torque wrench which can provide a readily determinable, non-abrupt indication when the preset torque value has been reached.

It is therefore the object of the present invention to provide an adjustable torque wrench having a readily and accurately adjustable torque value setting mechanism in the form of a spring biased slide assembly and a means for indicating, preferably audible, when the preset torque value has been reached.

SUMMARY OF THE INVENTION

The present invention relates to a torque wrench capable of pre-setting specific torque values. The torque wrench comprises an elongated housing which rotatably supports an output drive shaft. The torque on the output drive shaft is transmitted through a plurality of levers which are pivotally mounted within the housing. One of the levers is journalled to the output drive shaft for rotation therewith and the remaining levers are pivotally secured to the housing adjacent first ends thereof along the longitudinal center line of the housing. In the preferred embodiment, four such levers are utilized. With the exception of the last of these levers, the second end of each of the first three levers are engaged with the first end of the next, adjacent lever for the transmission of torque.

Adjustably secured within a longitudinal slot of the housing is a spring assembly for setting the desired torque value of the wrench. This torque value setting assembly acts between the housing and at least one of the levers to apply a force to the lever which must be overcome in order for the lever to pivot. The pivoting of the lever is directly proportional to the torque exerted on or by the wrench. The torque value setting device is easily adjustable longitudinally of the housing to vary the distance between the pivot point of the lever upon which it acts and the housing.

Secured to the second end of the fourth lever is a means for indicating when the torque value set by the torque value setting assembly has been reached. In the preferred embodiment, this indicating arrangement constitutes a weight which is arranged to make a sound by hitting an inside surface portion of the housing when the preset torque value has been reached to thereby provide an audible indication.

Therefore, the present invention provides a torque wrench which has an easily adjustable torque value setting device and a means for readily ascertaining when the preset torque value has been reached. These and other aspects of the invention will become more readily apparent by reference to the following detailed description of a preferred embodiment shown in the drawings.

DESCRIPTION OF THE PREFERRED EMBODIMENT

Figure 1:
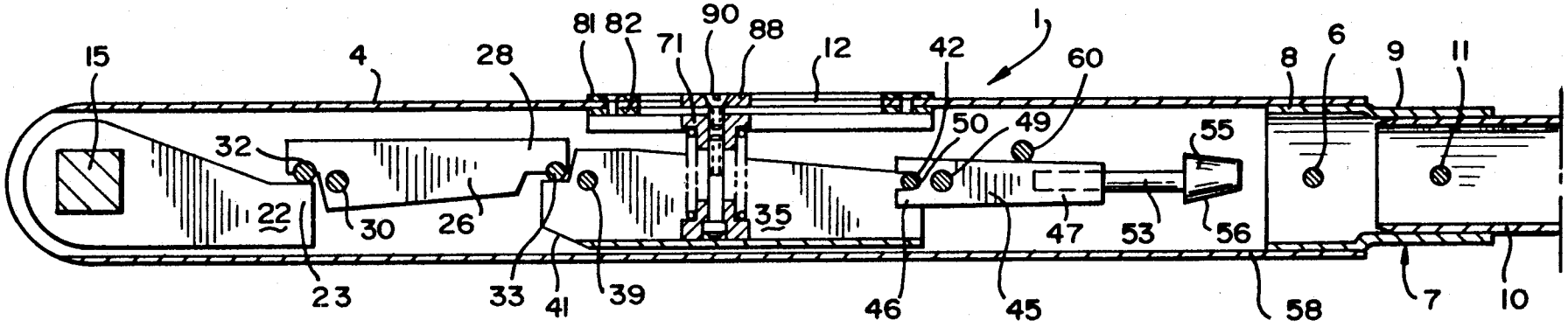
FIG. 1 is a cross-sectional view showing the torque wrench of the invention in a non-torqued state.
Figure 2:
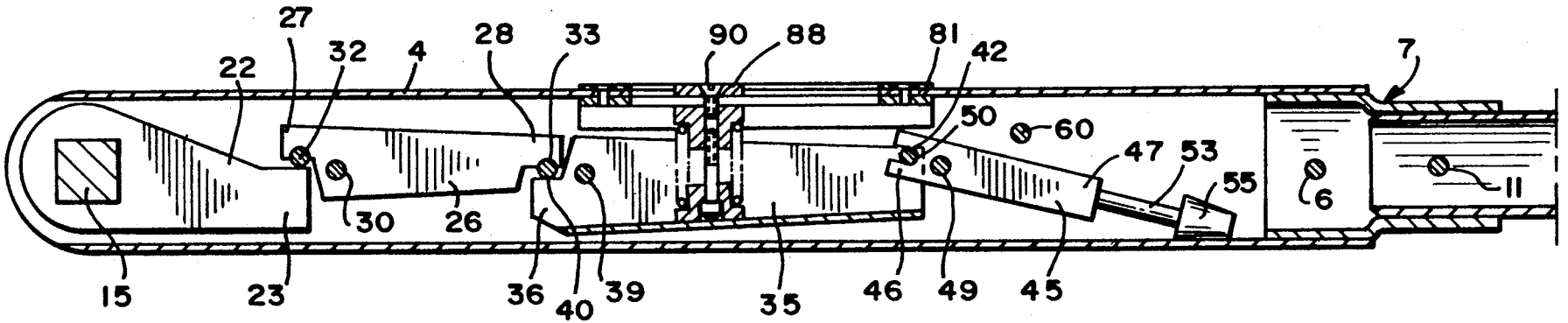
FIG. 2 shows the same cross section as FIG. 1 but wherein the wrench has been torqued to its preset value.
Figure 7:
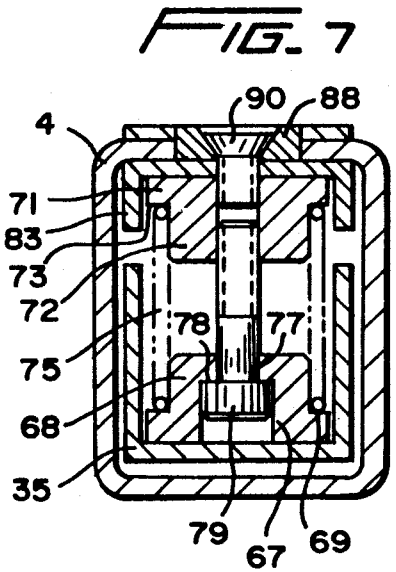
FIG. 7 shows a cross-sectional view of the torque value setting assembly taken along line 7—7 in FIG. 6.

The torque wrench of the present invention, generally indicated at 1 in FIGS. 1 and 2, comprises an elongated housing 4 which, as depicted in FIG. 7, is rectangular in cross-section. Fixedly secured to elongated housing 4 by means of a rivet 6 is a handle adapter 7 having a first end 8 which is rectangular in cross-section and is received within housing 4 and secured thereto by the rivet 6. The other end 9 of handle adapter 7 is circular in cross section and is adapted to receive a handle 10. Handle 10 is releasably secured within handle adapter 7 by means of a removable pin 11 or the like. By removal of pin 11, handle 10 can be readily withdrawn from of handle adapter 7 such that the torque wrench 1 may be stored in a more compact configuration. Housing 4 of torque wrench 1 also includes a longitudinal slot 12 which will be explained more fully below.

Figure 3:
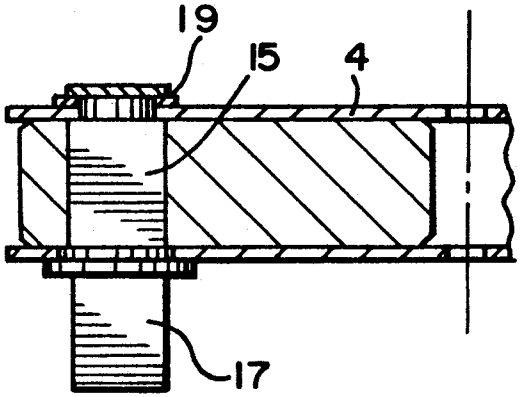
FIG. 3 shows a cross-sectional view of the mounting of the output drive shaft within the housing of the torque wrench.

As shown best in FIGS. 1-3, torque wrench 1 includes an output drive shaft 15 having a drive shaft extension 17. Output drive shaft 15 is rectangular in cross section and is rotatably secured to housing 4 by means of a clip 19. Drive shaft extension 17 is adapted to receive various size sockets (not shown) as is known in the art.

Figure 4:
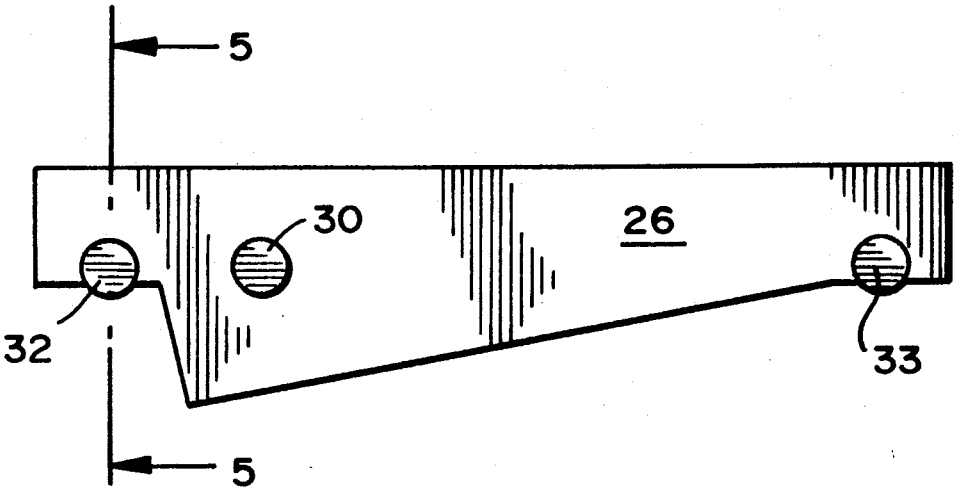
FIG. 4 shows an enlarged top view of one of the levers show in FIGS. 1 and 2.
Figure 5:
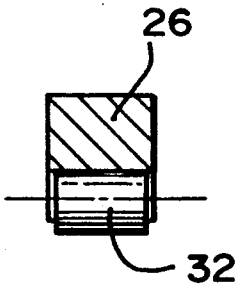
FIG. 5 is a cross-sectional view taken along line 5—5 in FIG. 4.

With reference to FIGS. 1 and 2, located within housing 4 are a plurality of levers 22, 26, 35, 45. First lever 22 has one end journalled to output drive shaft 15 and a second free end 23. Second lever 26 includes first and second ends 27, 28 respectively and is pivotally secured to housing 4 by means of pivot pin 30 located adjacent first end 27. With reference to FIGS. 4 and 5, press fit into a bore formed in first end 27 of second lever 26 is a rolling pin 32. The bore in first end 27 does not extend entirely through second lever 26 so that rolling pin 32 is retained within second lever 26 in both the longitudinal and lateral direction of torque wrench 1, as depicted, since second lever 26 extends around greater than 50% of the circumference of rolling pin 32. The bore in first end 27 does not extend entirely through second lever 26 so that rolling pin 32 is retained within second lever 26 into and out of the page as depicted in FIG. 4 by housing 4 and second lever 26. Second end 28 of second lever 26 also includes a rolling pin 33 mounted in a similar fashion. As clearly shown in FIGS. 1 and 2, rolling pin 32 engages second end 23 of first lever 22 while rolling pin 33 engages a third lever 35 as will be more fully explained below.

Third lever 35 includes a first end 36 and a second end 37 and is pivotally secured within housing 4 by means of pivot pin 39. The first end 36 of lever 35 includes a ledge portion 40 and a sloped portion 41. Ledge portion 40 is engaged by rolling pin 33 of second lever 26. The first end 36 of third lever 35 is provided with slope portion 41 to ensure no interference between first end 36 and housing 4 when third lever 35 pivots about pivot pin 39. Mounted to third lever 35, adjacent second end 37, is a pin 42, the function of which will be explained more fully below.

Torque wrench 1 further includes a fourth lever 45 having a bifurcated first end 46 and a second end 47 having a bore formed therein. Fourth lever 45 is pivotally secured within housing 4 by means of pivot pin 49. Recess 50, formed by the bifurcated end 46, receives pin 42 of third lever 35. Mounted within the bore in second end 47 of fourth lever 45 is a shaft 53. Shaft 53 may be threaded, glued or otherwise secured in the bore by any means known in the art. Shaft 53 carries on its other end a weight 55. Weight 55 is depicted as conical in shape, but it is to be understood that this configuration is merely intended to show that weight 55 includes a cammed surface portion 56 adapted to conform to an inside surface portion 58 of housing 4.

It should be noted that each of the four levers 22, 26, 35, 45 are pivotable about axes substantially lying along the longitudinal centerline of housing 4. Due to the interconnections of the first and second ends of the levers, rotation of first lever 22 will be transmitted to first end 27 of second lever 26 through rolling pin 32 causing second lever 26 to pivot, in the clockwise direction as depicted in FIGS. 1 and 2, about pivot pin 30. Pivoting of second lever 26 will cause pivoting of third lever 35 in a counterclockwise direction due to the engagement of roller pin 33 on second end 28 of second lever 26 with ledge portion 40 of third lever 35. Pivoting of third lever 35 about pivot pin 39 will cause pivoting of fourth lever 45 about pivot pin 49 due to the presence of pin 42 within recess 50 of bifurcated end 46. When a predetermined torque value has been reached, set in a manner which will be more fully explained below, weight 55, secured to second end 47 of fourth lever 45 by means of shaft 53, will hit inside surface portion 58 thereby making an audible noise which can be used by the operator of the torque wrench 1 as an indication that the desired torque value has been reached.

Fixedly secured to housing 4 laterally adjacent the longitudinal centerline thereof is a pivot limiting pin 60. When torque wrench 1 is in its non-torqued state as shown in FIG. 1, fourth lever 45 engages pin 60 to prevent any over-center rotation of lever 45.

Figure 6:
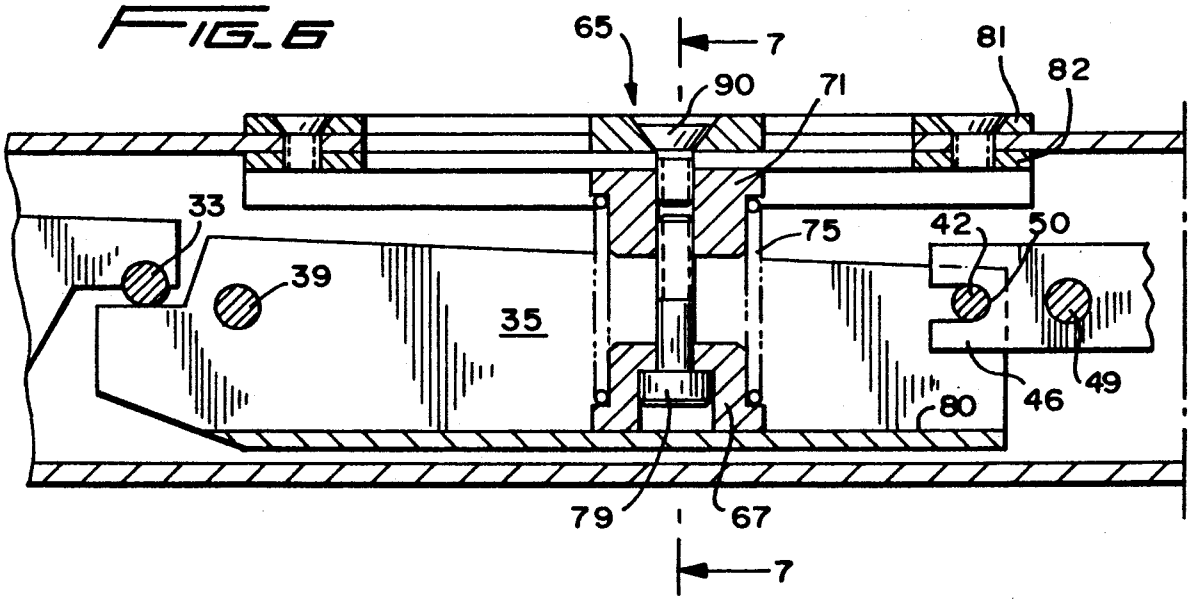
FIG. 6 shows an enlarged cross-sectional view of the third lever and torque value setting assembly shown in FIGS. 1 and 2.
Figure 8:
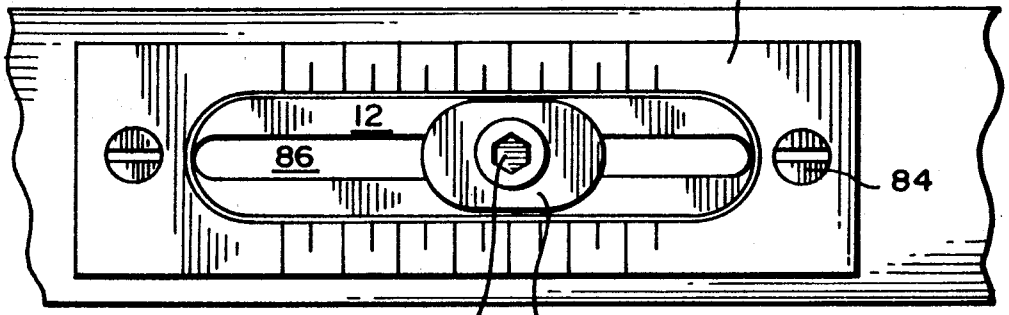
FIG. 8 is a top view of the torque value setting assembly showing its mounting within the torque wrench housing.

The specific manner in which the desired torque value can be set will now be explained in detail with reference to FIGS. 6-8. The torque value setting assembly of the present invention is generally indicated at 65 and includes a first collar member 67 having a reduced diameter portion 68 defining an annular shoulder 69; a second, internally threaded collar member 71 having a reduced diameter portion 72 defining an annular shoulder 73; and a compression spring 75 located between the first and second collar members 67, 71 and abutting annular shoulders 69 and 73. First collar member 67 includes a central bore having a first diameter portion 76 and a smaller diameter portion 77 thereby defining an annular abutment surface 78 therebetween. Received within this bore is a bolt 79 having a head which is adapted to engage abutment surface 78 and which is adapted to be threadably received within second, threaded collar member 71. As should be readily apparent from this description, tightening or loosening of bolt 79 functions to adjust the spring rate of compression spring 75 and the distance between collar member 67 and 71.

The torque value setting assembly 65 acts between base surface portion 80 of third lever 35 and housing 4. As previously stated, housing 4 includes a slot 12. Secured to housing 4, above and below slot 12, is an upper mounting plate 81 and a lower mounting plate 82 respectively. Lower mounting plate 82 is U-shaped in cross section and includes downwardly extending legs 83 as depicted in FIG. 7. Upper and lower mounting plates 81 and 82 are secured to housing 4 and each other by means of any fasteners 84 known in the art such as screws, rivets etc. Lower mounting plate 82 includes a slot 86 extending the longitudinal direction of housing 4. Slot 86 is substantially the same length as slot 12 but can be made slightly longer or shorter without departing from the spirit of the invention. Slot 86, however, is more narrow than slot 12. Torque value setting assembly 65 includes a slide member 88 adapted to slide within slot 12 of housing 4. Slide member 88 is formed with a central bore 89 which receives a torque value setting screw 90. Torque value setting screw 90, in turn, extends through slot 86 and is threadably received within second collar member 71.

By the above description it can be readily seen that when torque value setting screw 90 is loosened, slide member 88 can be used to adjust the position of torque value setting assembly 65 within slots 12 and 86 and the location at which first sleeve member 67 abuts base surface portion 80 of third lever 35. When torque value setting assembly 65 is adjusted to the desired position, torque value setting screw 90 is tightened so as to sandwich lower mounting plate 82 between slide member 88 and second collar member 71 to thereby fix torque value setting assembly 65 within slot 12. Depending upon the relative distance between torque value setting assembly 65 and pivot pin 39 of third lever 35, the required torque which must be exerted in order to pivot levers 22, 26, 35 and 45 is adjusted. Therefore, after torque wrench 1 is calibrated, which can be marked by the use of a calibration label such as that indicated at 93, the user of torque wrench 1 can simply adjust the position of torque value setting assembly 65 within slots 12 and 86 to thereby adjust the torque required to pivot lever 45 to the point where surface 56 of weight 55 will come into engagement with inside surface portion 58 of housing 4. When this engagement occurs, an audible signal will be produced which can indicate to the user that the desired or preset torque value has been reached.

It should be noted that the torque value setting assembly 65 and the audible signalling is arranged to work when torque wrench 1 is used for tightening purposes. Torque wrench 1 is free to operate without the successive pivoting of the levers when used to loosen objects. Torque value setting assembly 65 can itself be adjusted when removed from housing 4 by tightening or loosening of bolt 79. It is also possible to provide an access hole (not shown) through lever 35 and housing 4 for this purpose.

Although disclosed with respect to a particular embodiment, it can readily be seen that various changes and/or modifications can be made without departing from the spirit or scope of the present invention. In general, any changes and/or modifications may be made without departing from the spirit or scope of the present invention as defined by the following claims.

I claim:

1. A torque wrench capable of pre-setting specified torque values comprising:

an elongated, hollow housing having first and second ends;

an output drive shaft rotatably supported by said housing adjacent said first end, said output drive shaft including a drive extension protruding from said housing substantially perpendicular to the length of said housing;

a plurality of levers pivotally mounted within said housing, a first of said plurality of levers being journalled to said output drive shaft for rotation therewith, the remaining levers having first and second ends and being pivotally secured to said housing adjacent their first ends at spaced intervals along the longitudinal centerline of said housing and, with the exception of the last of said plurality of levers, the second end of each of said remaining levers being engaged with the first end of the next, adjacent lever;

torque value setting means extending substantially transversely between said housing and at least one of said plurality of levers and including biasing means for developing and applying a force to said at least one lever which said at least one lever must overcome in order to pivot, said torque value setting means being selectively, adjustably mounted relative to said housing to alter the pivoting resistance by varying the position along the length of said at least one lever upon which said biasing means acts; and means for indicating when the torque value set by the torque setting means has been reached.

2. A torque wrench as claimed in claim 1 wherein said means for indicating when the set torque value has been reached is an audible indicator.

3. A torque wrench as claimed in claim 2 wherein said means for indicating when the set torque value has been reached comprises a weight secured to the second end of said last lever and which is adapted to make a sound by hitting an inside surface portion of said housing.

4. A torque wrench as claimed in claim 3 wherein said weight includes a cammed outside surface which substantially conforms to the inside surface portion of said housing when said last lever is pivoted so that said weight makes a surface contact with said housing.

5. A torque wrench as claimed in claim 2 wherein said housing includes a longitudinally extending slot intermediate said first and second ends, said torque value setting means being located within said housing so as to be adjustable within said slot.

6. A torque wrench as claimed in claim 5 further including means for releasably securing said torque value setting means within said slot.

7. A torque wrench as claimed in claim 6 wherein said torque value setting means comprises a pair of spaced collar members and a spring therebetween.

8. A torque wrench as claimed in claim 7 further comprising means for adjusting the relative distance between said collar members to adjust the compression of said spring.

9. A torque wrench as claimed in claim 6 wherein said torque wrench includes at least four levers pivotally mounted within said housing.

10. A torque wrench as claimed in claim 9 wherein the second lever includes roller bearing means at each of said first and second ends which are engaged with the second end of said first lever and the first end of the third lever respectively.

11. A torque wrench as claimed in claim 10 wherein said torque value setting means acts between said housing and the third lever.

12. A torque wrench as claimed in claim 10 further including a pin extending generally parallel to said output shaft and being attached to the second end of the third lever, said first end of the fourth lever being bifurcated and substantially surrounds said pin.

13. A torque wrench as claimed in claim 9 wherein said means for indicating when the torque value set by the torque value setting means has been reached is attached to the fourth lever.

14. A torque wrench as claimed in claim 13 wherein each of said levers pivot about axes lying substantially along the longitudinal centerline of said housing.

15. A torque wrench as claimed in claim 14 further comprising pivot limiting means secured to said housing, said pivot limiting means being adapted to be engaged by the fourth lever to prevent pivoting thereof beyond an over-center position.

16. A torque wrench as claimed in claim 1 further comprising a handle secured to the second end of said housing.

17. A torque wrench capable of pre-setting specified torque values comprising:

an elongated, hollow housing having first and second ends, said elongated housing including a longitudinal slot extending through said housing intermediate said first and second ends;

an output drive shaft rotatably supported by said housing adjacent said first end, said output drive shaft including a drive extension protruding from said housing substantially perpendicular to the length of said housing;

a plurality of levers pivotally mounted within said housing, a first of said plurality of levers being journalled to said output drive shaft for rotation therewith, the remaining levers having first and second ends and being pivotally secured to said housing adjacent their first ends at spaced intervals along the longitudinal centerline of said housing and, with the exception of the last of said plurality of levers, the second end of each of said remaining levers being engaged with the first end of the next, adjacent lever;

torque value setting means being slidable mounted within said slot and extending transversely between said slot and at least one of said plurality of levers to apply a force to said at least one lever which said at least one lever must overcome in order to pivot, said torque value setting means being selectively, adjustably mounted within said slot to alter the pivoting resistance by varying the position along the length of said at least one lever upon which said torque value setting means acts; and means for indicating when the torque value set by the torque setting means has been reached.

18. A torque wrench as claimed in claim 17 further including a calibration label attached to said housing about said slot.

19. A torque wrench as claimed in claim 17 wherein said torque value setting means comprises a pair of spaced collar members and a spring therebetween.

20. A torque wrench as claimed in claim 19 further comprising means for adjusting the relative distance between said collar members to adjust the compression of said spring.

* * * * *